US009208756B2

(12) United States Patent
Isaac

(10) Patent No.: US 9,208,756 B2
(45) Date of Patent: Dec. 8, 2015

(54) MUSICAL INSTRUMENT WITH AGGREGATE SHELL AND FOAM FILLED CORE

(71) Applicant: Troy Isaac, Sault Ste. Marie (CA)

(72) Inventor: Troy Isaac, Sault Ste. Marie (CA)

( * ) Notice: Subject to any disclaimer, the term of this patent is extended or adjusted under 35 U.S.C. 154(b) by 0 days.

(21) Appl. No.: 14/253,155

(22) Filed: Apr. 15, 2014

(65) Prior Publication Data

US 2014/0311315 A1 Oct. 23, 2014

Related U.S. Application Data

(60) Provisional application No. 61/814,380, filed on Apr. 22, 2013.

(51) Int. Cl.

| | |
|---|---|
| ***G10D 3/00*** | (2006.01) |
| ***G10D 3/02*** | (2006.01) |
| ***G10D 1/00*** | (2006.01) |
| ***G10D 1/08*** | (2006.01) |

(52) U.S. Cl.

CPC ..... *G10D 1/005* (2013.01); *G10D 1/085* (2013.01)

(58) Field of Classification Search

USPC ..... 84/267

See application file for complete search history.

(56) References Cited

U.S. PATENT DOCUMENTS

| | | | | |
|---|---|---|---|---|
| 3,427,915 | A | 2/1969 | Mooney | |
| 3,769,871 | A * | 11/1973 | Cawthorn | 84/291 |
| 4,144,793 | A | 3/1979 | Soika et al. | |
| 4,190,739 | A | 2/1980 | Torffield | |
| 4,290,336 | A * | 9/1981 | Peavey | 84/291 |
| 4,977,808 | A | 12/1990 | Thacker | |
| 5,054,356 | A * | 10/1991 | Farnell, Jr. | 84/291 |
| 5,267,499 | A | 12/1993 | Othon | |
| 5,271,974 | A | 12/1993 | Upchurch | |
| 5,469,769 | A | 11/1995 | Sawada et al. | |
| 5,543,186 | A | 8/1996 | Andersen et al. | |
| 5,889,221 | A * | 3/1999 | Dejima | 84/291 |
| 6,099,947 | A | 8/2000 | Pushpalal et al. | |
| 6,770,804 | B2 | 8/2004 | Schleske | |
| 7,014,726 | B2 | 3/2006 | Whiting | |
| 7,342,161 | B1 | 3/2008 | Fox | |
| 7,482,518 | B1 | 1/2009 | Disanto | |
| 7,507,885 | B2 * | 3/2009 | Coke | 84/291 |
| 7,645,354 | B1 | 1/2010 | Disanto | |
| 8,138,403 | B1 * | 3/2012 | Kemp | 84/291 |
| 2002/0104423 | A1 * | 8/2002 | Verd | 84/291 |
| 2005/0076763 | A1 * | 4/2005 | Langeman | 84/290 |
| 2005/0284281 | A1 * | 12/2005 | Suyama | 84/294 |
| 2009/0013848 | A1 * | 1/2009 | Farnell, Jr. | 84/291 |
| 2009/0308220 | A1 | 12/2009 | DiSanto | |
| 2010/0037751 | A1 * | 2/2010 | Kim | 84/453 |
| 2010/0101396 | A1 * | 4/2010 | Ayers | 84/294 |
| 2013/0032019 | A1 * | 2/2013 | Miloslavsky | 84/291 |

* cited by examiner

*Primary Examiner* — Christopher Uhlir

(57) ABSTRACT

A musical instrument includes a body having an outer shell, an internal cavity defined by that outer shell and a center plate dividing that internal cavity into a first chamber and a second chamber. In one embodiment, a foam core fills the internal cavity.

20 Claims, 5 Drawing Sheets

MUSICAL INSTRUMENT WITH AGGREGATE SHELL AND FOAM FILLED CORE

This utility patent application claims the benefit of priority in U.S. Provisional Patent Application Ser. No. 61/814,380 filed on Apr. 22, 2013, the entirety of the disclosure of which is incorporated herein by reference.

TECHNICAL FIELD

The present invention relates generally to the musical instrument field and, more particularly, to musical instruments made from novel methods and construction materials, thereby providing enhanced sound quality while still being relatively light in weight.

BACKGROUND

Musical instruments, including stringed musical instruments such as guitars, have been made from a number of different materials in order to obtain desired sound characteristics including clarity and sustain. For example, U.S. Pat. No. 3,769,871 to Cawthorn discloses a guitar including a body made from a mineral or petrified matter such as granite, marble, onyx, rose quartz, petrified wood or agate. U.S. Pat. No. 7,482,518 to DiSanto discloses stringed instruments such as guitars and violins made from high density veneers composed of stone, metal, ceramic or the like. Further, U.S. Pat. No. 3,427,915 to Mooney teaches stringed instruments with laminated sound panels constructed from two outer-plies made of high-modulus material sandwiched around an inner-ply made of a low density material.

As will be described below, this document discloses a novel and improved construction for the body of a musical instrument such as, but not limited to, a stringed musical instrument such as a guitar. The body comprises a core and an outer shell mounted to a center plate. In a preferred embodiment, the body includes a full foam core. Such a solid body made with these construction parameters provides an enhanced sound quality. More specifically, the hard outer shell provides for desired resonance properties and a pronounced sustain. The foam filled core provides support and rigidity to the shell while reducing the overall weight of the instrument. In addition, the open cell structure of the foam core acts as a sound chamber amplifying the sound of the instrument.

SUMMARY

In accordance with the purposes described herein, an improved musical instrument is provided. The musical instrument comprises a body including an outer shell, an internal cavity defined by the outer shell and a center plate dividing the internal cavity into a first chamber and a second chamber. The size and design of the center plate may vary. For example, the center plate may fill about 10% to about 100% of the internal cavity's volume. In one particularly useful embodiment the body is solid in construction with no hollow spaces. The outer shell is made from a mixture of cement, sand, plasticizer and water. Still further, in some embodiments the outer shell also includes a material selected from a group consisting of a de-foaming agent, an integral colorant, a filler material, expanded glass beads, fly ash, light weight aggregates, admixes and mixtures and combinations thereof. Further, the foam filled core is made from a material selected from a group consisting of a silica aerogel, a carbon nanotube aerogel, a metallic foam, a polymeric foam, a metallic microlattice, and mixtures and combinations thereof. Polymeric foams include, for example, urethane/polyurethane foam, silicone foam, polyvinyl chloride foam, polystyrene foam, polyimide foam and mixtures and combinations thereof. In one particularly useful embodiment the foam filled core is made from polyurethane foam of differing possible densities strong enough to provide support for the outer aggregate shell.

In accordance with an additional aspect, the musical instrument is a guitar, such as an electrical guitar, wherein the neck and head stock may be made of any suitable material. In such a construction the body receives and carries a bridge, a bridge/saddle combination and a pick-up. More specifically, in one embodiment the outer shell includes a cavity defining a seat for receiving and holding the pick-up, controls and other musical components such as batteries, switches and whammy bar components including combinations and variations of such accessories.

In accordance with yet another aspect, a method is provided for forming a body of a musical instrument. That method comprises the steps of (a) forming a front outer shell, (b) forming a rear outer shell, and (c) joining the front and rear outer shells by connecting them to a center plate. In one possible embodiment, the method includes at least partially filling an internal cavity defined by the joined outer shells with a foam core. In one possible embodiment the internal cavity is completely filled by the foam core.

BRIEF DESCRIPTION OF THE DRAWINGS

The accompanying drawings incorporated herein and forming a part of the specification, illustrate several aspects of the musical instrument and together with the description serve to explain certain principles thereof. In the drawing.

Reference will now be made in detail to the present preferred embodiment of the musical instrument, an example of which is illustrated in the accompanying drawing figures.

DETAILED DESCRIPTION

Figure 1:
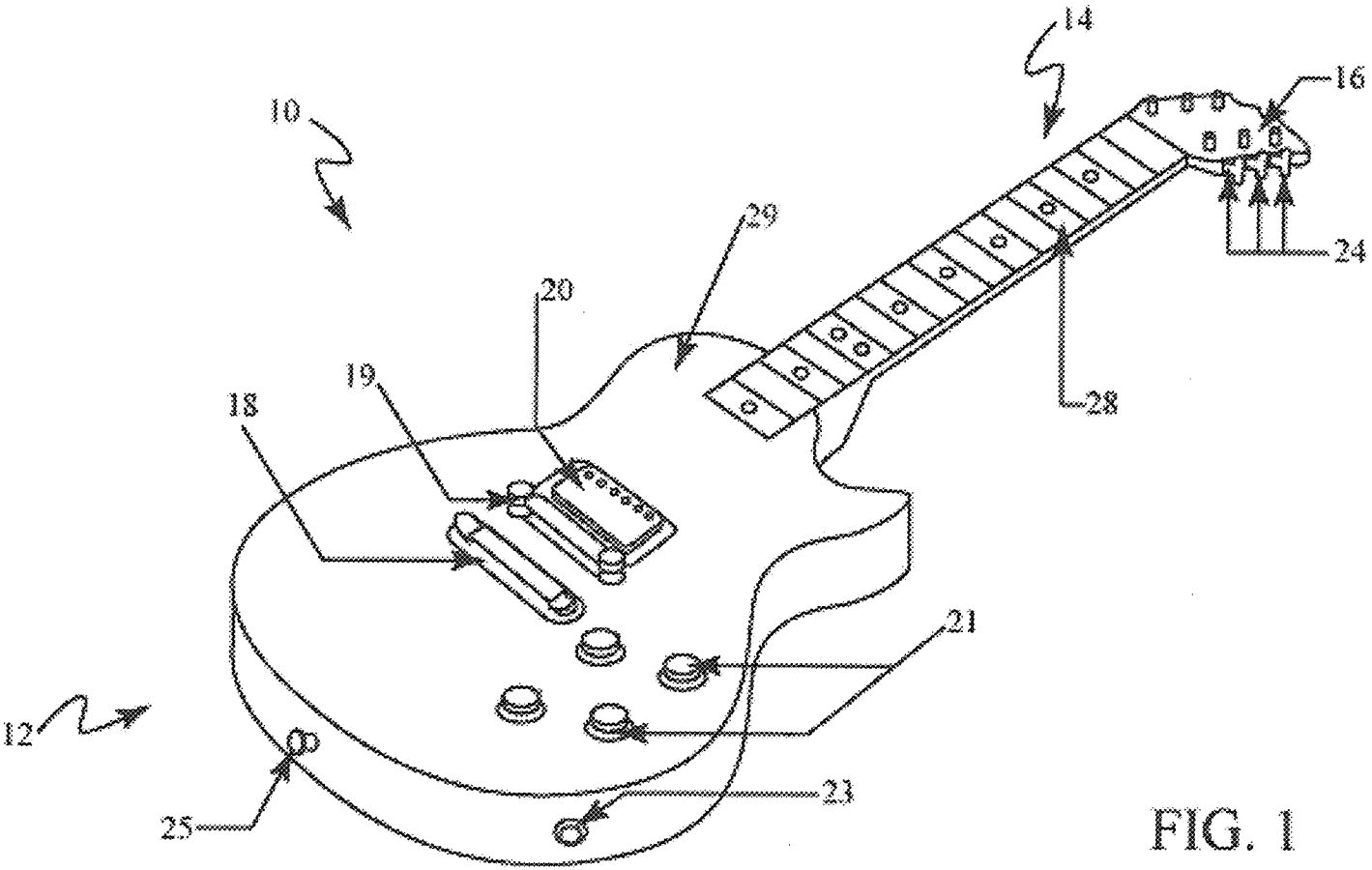
FIG. 1 is a perspective view of a musical instrument in the form of an electric guitar.

Reference is now made to FIG. 1 illustrating a musical instrument in the form of an electric guitar 10. While an electric guitar 10 is illustrated, it should be appreciated that a musical instrument, as defined in this document, includes but is not limited to, stringed musical instruments such as guitars, pianos, harpsichords, banjos, violins, violas, bass violins and the like. As illustrated the guitar 10 includes a body 12, a neck 14 and a head stock 16. The body carries a bridge 18, saddle 19, a pick-up 20, controls 21, a jack 23 and a strap button 25. The pick-up controls 21 may be provided in a recess or pick-up cavity 20 formed in the body 12. The head stock 16 includes a series of tuners 24. Strings (not shown) extend from the bridge 18 to the tuners 24 overlying a fret board 28 carried on the neck 14. There are channels drilled into the body for wiring traces. There will also be blind holes drilled for screws attaching guitar related chattels to the body.

Figure 2:
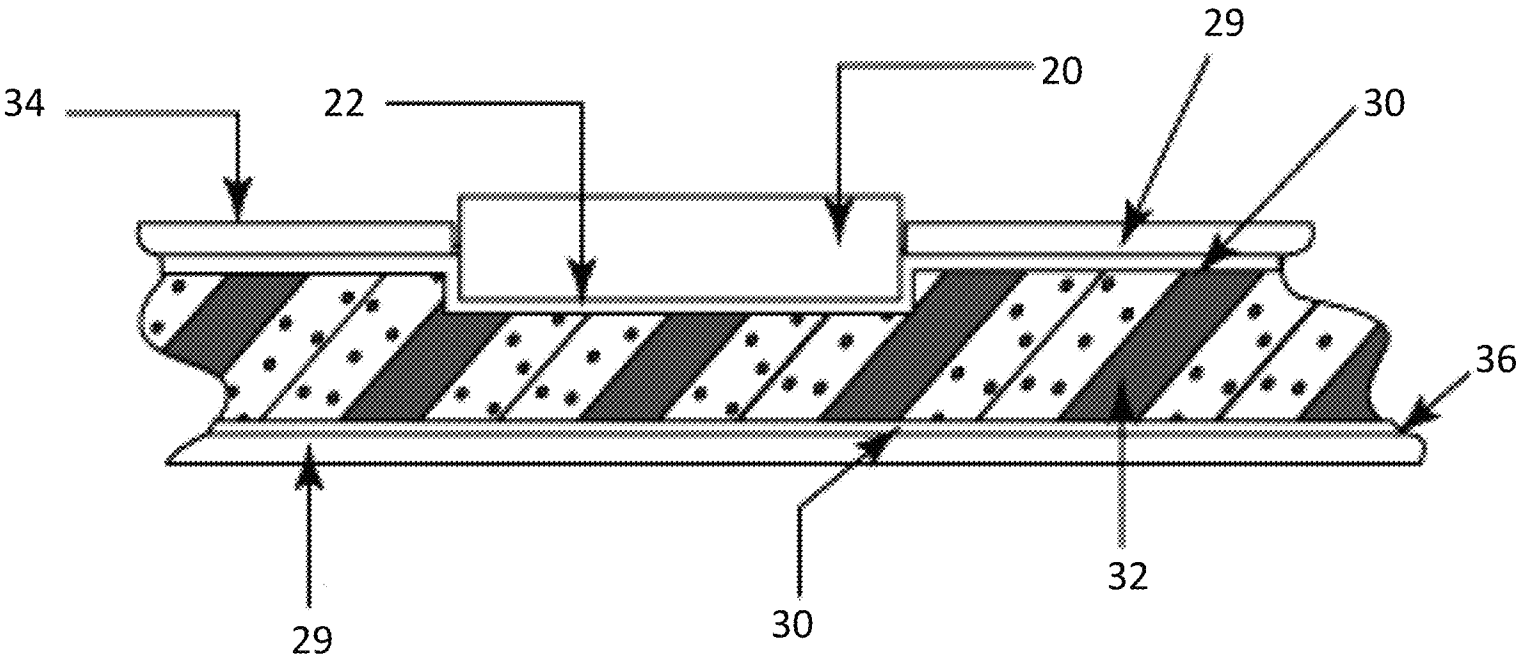
FIG. 2 is a cross sectional view through the body of the musical instrument illustrated in FIG. 1 so as to illustrate the cavity and seat that receive and hold the pick-up controls.

As illustrated in FIG. 2, the body 12 is formed from or includes an aggregate outer shell 29, a support structure 30, such as a reinforcing wire mesh to strengthen the shell, and may further include an optional foam filled core 32. Thus, the body 12 is solid or semi-solid from the first or upper surface 34 to the second or lower surface 36 thereof. No hollow spaces are present beyond the open cell structure of the foam core. In other embodiments the foam only fills a part of the internal space. In still other embodiments, there is no foam core.

In one particularly useful embodiment the aggregate outer shell 29 is made from a mixture of cement (such as Portland cement), sand, plasticizer and water. The aggregate outer shell mixture may further include additives including, for example, materials selected from a group consisting of a de-foaming agent, an integral colorant, a filler material, expanded glass beads, fly ash, light weight aggregates, admixes and mixtures and combinations thereof.

The foam filled core 32, when present, is made from a material selected from a group of foams consisting of polyurethane foam, a silica aerogel, a carbon nanotube aerogel, a metallic foam, a polymeric foam, a metallic microlattice, and mixtures and combinations thereof. Polymeric foams include, for example, urethane/polyurethane foam, silicone foam, polyvinyl chloride foam, polystyrene foam, polyimide foam and mixtures and combinations thereof. In one more particularly useful embodiment the foam filled core is made from polyurethane foam having a 10 weight. Of course, other weight measures may be utilized.

In one possible embodiment the neck and head stock are made from a material selected from a group consisting of plastic, wood, aggregate, metal, foam and mixtures and combinations thereof. In another possible embodiment the neck 14 and/or head stock 16 may also be made from an aggregate outer shell and a foam filled core in the same manner as the body 12.

The method for forming the body 12 of the musical instrument 10 comprises the steps of (a) forming a front outer shell for the body of the musical instrument, (b) forming a rear outer shell for the body of the musical instrument, and (c) joining the front and rear outer shells by connecting them to a center plate. In one possible embodiment, the method further includes at least partially filling an internal cavity defined by the joined outer shells with a foam core. In another possible embodiment, the internal cavity is completely filled by the foam core. The foam core is made from a liquid material that expands and sets to form a core that fills the internal cavity within the shell.

In one possible method, first the aggregate material of cement, sand, plasticizer and water as well as any optional additives including, for example, defoaming agent, colorant, filler material, expanded glass beads, fly ash, light weight aggregates, admixes and mixtures and combinations thereof is mixed into a homogeneous mixture. That mixture is then poured into the mold. The mold is then rotated (the mold can also be held motionless to build up certain and varying thickness to the bodies outer shell) as the aggregate material sets in accordance with standard roto-casting procedures. This creates a hollow shell of aggregate material having a thickness that will generally range from about 0.125-0.375 in. and would typically weigh approximately 5-6 lbs. The shell is then removed from the mold and the end button or clip where the strap attaches, is drilled through into the hollow core area. The urethane foam liquid precursor is then poured into the opening. As the foam sets, it expands and slightly rises out of the hole indicating that the hollow within the shell is filled with an open cell foam. The poly-foam is very sticky as it sets and adheres to the inside of the aggregate shell creating an extremely rigid and tough core that is light in weight but provides substantial mechanical support to the thinner outer aggregate shell. The aggregate shell may be treated with dyes, stains, sealers and polishes to provide the desired color or appearance. Alternatively, an integral colorant may be added to the material that is mixed to form the aggregate shell to produce a complete through-color product if desired. Further, for certain applications both procedures may be used in order to provide the desired ornamental effect.

Figure 3:
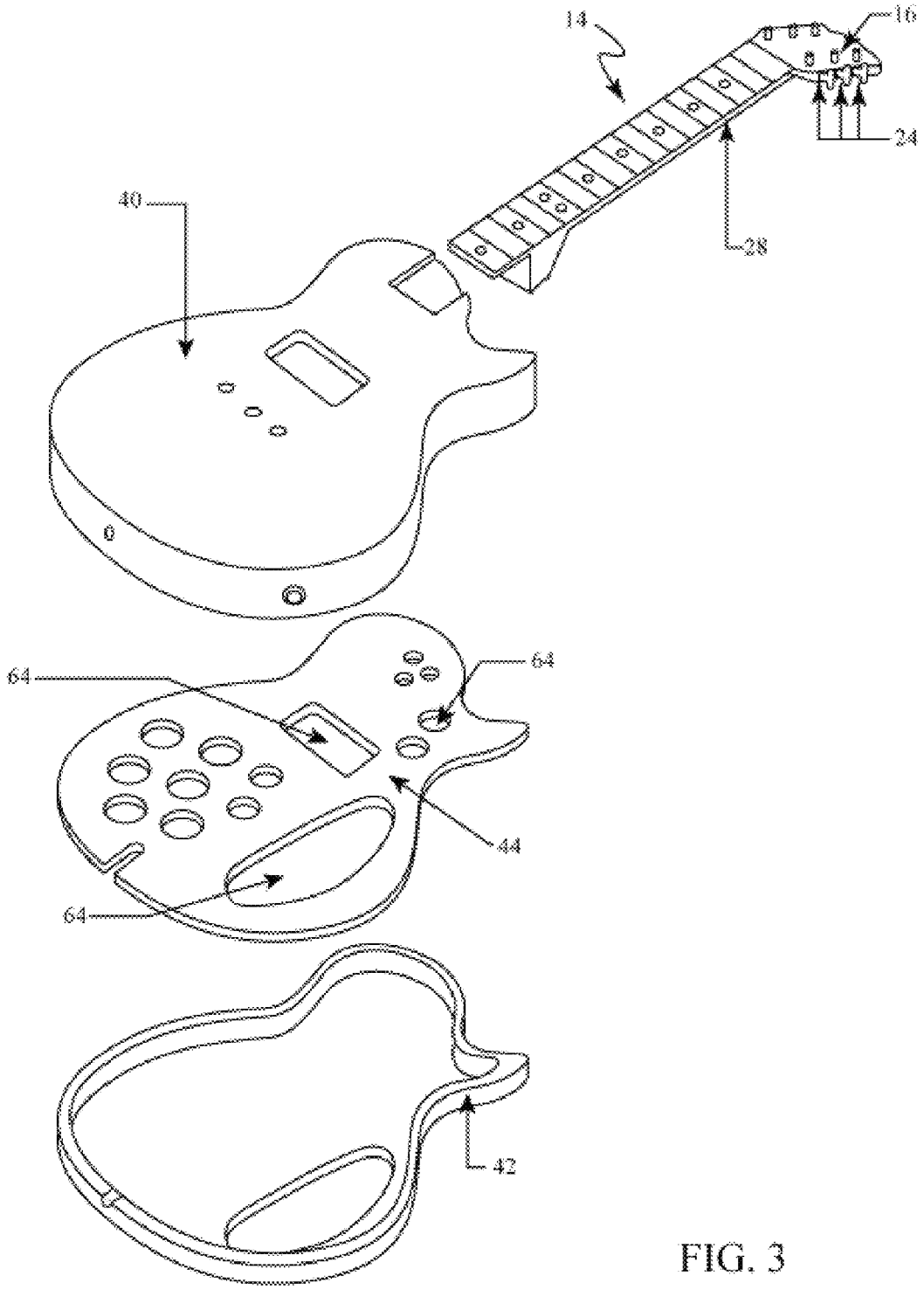
FIG. 3 is an exploded perspective view of one of the preferred embodiments.
Figure 4:
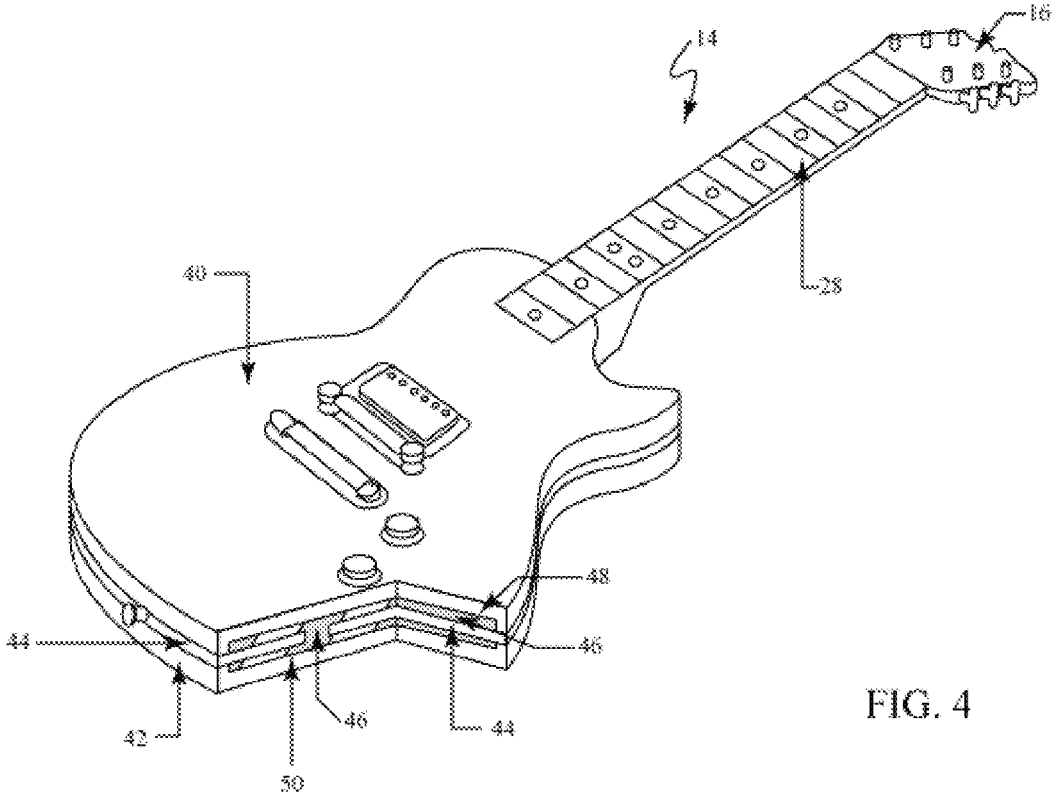
FIG. 4 is a perspective and partially cross-sectional view of the assembled FIG. 3 embodiment.

In yet another embodiment best illustrated in FIGS. 3 and 4, the shell of the body is created using two molds, one for the top, face or front outer shell 40 face and one for the bottom, back or rear outer shell 42. The open mold halves are then hand packed with a stiff aggregate slurry, creating a multi-color marble/stone effect. A wire mesh or structured backing is then provided over the back of the casting material for purposes of reinforcement. The cutting line or mold edge is then cleaned to be joined with its other cooperating half.

At this time inserts may be positioned in the mold, integrated with the aggregate mixture for such things as controls, bridge and pick-up mounting plates, including decorative inserts and bindings. Pick-up cavities may be lined with metal flake or metal lining to insulate the magnetic field around the pick-ups thus deterring electronic interference. Cavities would not require aggregate and thus, could be open to the foam core to allow easier attachment of accessories or inserts and to reduce weight.

The two half shells 40, 42, still in the molds, are then clamped together around a center plate 44 and spun in a roto-casting device. The foam expands and functions as an adhesive or an additional adhesive to connect the two half shells 40, 42 to the center plate 44 and join the entire outer aggregate shell together. The liquid material that forms the foam core 46 is poured into the cavity on one or both sides of the center plate prior to completing the casting procedure.

As illustrated in FIG. 3, the resulting instrument body 50 includes a front outer shell 40 and a rear outer shell 42. The outer shells 40, 42 are mounted or connected to the center plate 44 by an adhesive or the foam core 46. The internal cavity of the body is divided into first and second chambers 48, 50 which are filled with a foam core 46, as previously explained. The center plate 44 may vary in size and shape. For example the center plate 44 may be relatively thin so as to fill as little as 10% of the internal cavity or relatively thick so as to fill almost 100% of the internal cavity. In other possible embodiments, the center plate 44 fills 15%, 20%, 25%, 30%, 35%, 40%, 45%, 50%, 55%, 60%, 65%, 70%, 75%, 80%, 85%, 90%, 95%, 98% of the internal cavity thereby reducing the size/volume of the space that may be filled by the foam of the core 46.

The center plate 44 may be solid and continuous or include one or more optional through holes 64 as illustrated in FIG. 3. The holes 64 may be of the same or different sizes and shapes. In one embodiment, the foam core 46 fills only the first chamber 48 between the top shell 40 and the center plate 44. In one embodiment the foam core 46 fills only the second chamber 50 between the bottom shell 42 and the center plate 44. In one embodiment the foam core 46 fills both chambers 48, 50 of the internal cavity on both sides of the center plate 44.

Figure 5:
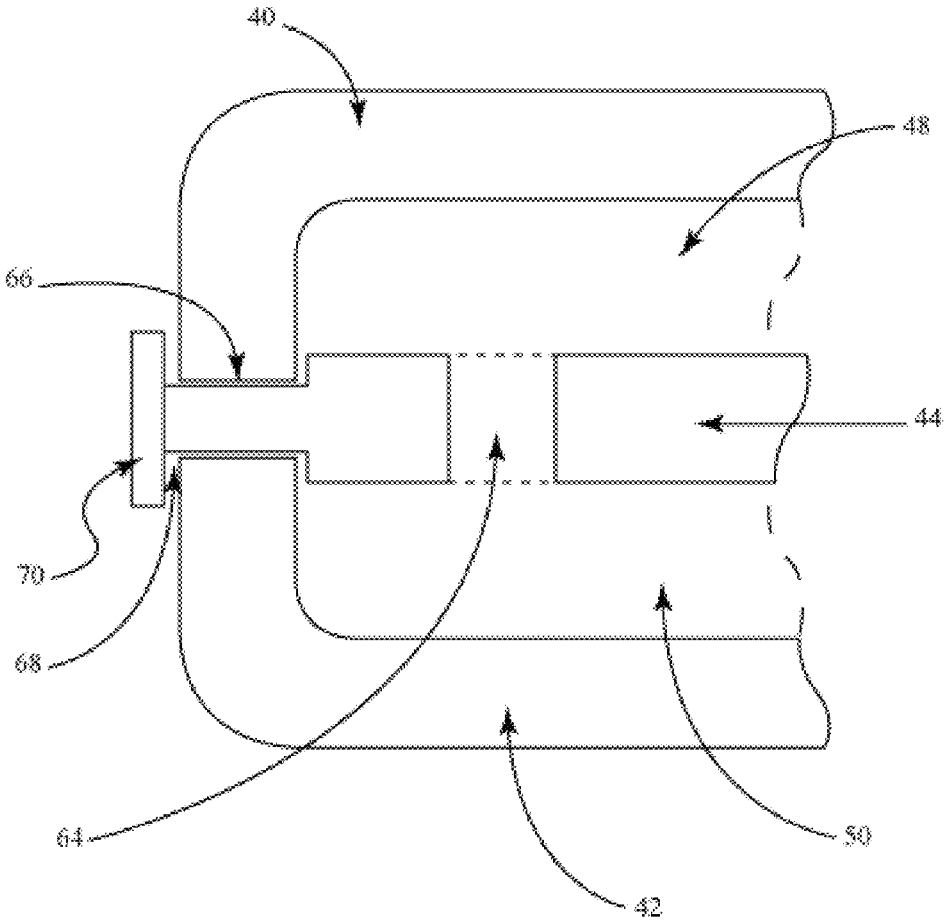
FIG. 5 is a detailed schematic illustration of the connection of the front and rear outer shells with the center plate.

In yet another possible embodiment, the front outer shell 40 and rear outer shell 42 are made from materials other than aggregate. For example, the outer shells 40, 42 may be carved or machined from wood. Similarly, the center plate 44 may be machined from the same or a different type of wood. As illustrated in FIG. 5, the center plate 44 may include two channels 66, 68 in the opposing faces of the center plate. The first channel 66 received the edge of the outer shell 40 while the second channel 68 received the outer edge of the rear shell 42. An adhesive may be provided in the channel to complete the connection between the outer shells 40, 42 and the center plate 44. The flange 70 hides the seam lines.

In yet another embodiment, the outer shells 40, 42 made from wood, metal or aggregate material while the center plate 44 is made from hardwood. The shells 40, 42 are mounted to the center plate 44 with an adhesive. This embodiment may be hollow or filled with a dense foam core. In still another embodiment, the shells 40, 42 are cast aggregate, the center plate 44 is a hardwood and the internal cavity is filled with a dense but light foam core.

The foregoing has been presented for purposes of illustration and description. It is not intended to be exhaustive or to limit the embodiments to the precise form disclosed. Obvious modifications and variations are possible in light of the above teachings. For example, casting and molding techniques other than roto-casting may be used to form the shell. These include, but are not limited to, centrifugal casting, continuous casting, die casting, evaporative-pattern casting, investment casting, permanent mold casting, plastic mold casting, resin casting, sand casting, shell molding, spray forming, injection molding, compression molding, transfer molding, extrusion, dip molding, rotational molding, thermoforming, laminating, hydro forming, vacuum molding, pressure plug assist, vacuum plug assist, matched mold and shrink fitting. In addition, the body may carry other parts and accessories such as, but not limited to, battery assemblies and wiring and/or wiring traces. Further, the center plate 44 may be made from still other, different materials. All such modifications and variations are within the scope of the appended claims when interpreted in accordance with the breadth to which they are fairly, legally and equitably entitled.

What is claimed:

1. A musical instrument, comprising:

a front outer shell and a rear outer shell, each of said shells having a base surface and a perimeter extending side wall terminating in an elevated end surface; and a center plate having opposite front and rear faces abutting said elevated end surfaces of said front and rear outer shells respectively, so that said center plate is secured between said shells, dividing an internal cavity collectively created between said shells into a first chamber and a second chamber.

2. The musical instrument of claim 1, wherein said center plate fills about 10% -about 100% of the volume of said an internal cavity.

3. The musical instrument of claim 2, further comprising a foam material filling at least a portion of at least one of said first and second chambers.

4. The instrument of claim 1, wherein said front and rear outer shells are made from a mixture comprising cement, sand, plasticizer and water.

5. The instrument of claim 4, each of said front and rear outer shells further comprising a material selected from a group including at least one of a de-foaming agent, an integral colorant, a filler material, expanded glass beads, fly ash, and an aggregate.

6. The instrument of claim 3, further comprising said foam material being selected from a group consisting of a silica aerogel, a carbon nanotube aerogel, a metallic foam, a polymeric foam, a metallic microlattice, a urethane foam, a polyurethane foam, a silicone foam, a polyvinyl chloride foam, a polystyrene foam, a polyimide foam and mixtures and combinations thereof.

7. The instrument of claim 3, wherein said foam material further comprises a polyurethane.

8. The instrument of claim 1, further comprising an adhesive for securing said front and rear outer shells to said center plate.

9. The instrument of claim 6, further comprising said foam material functioning as an adhesive to mount said front and rear outer shells to said center plate.

10. The instrument of claim 1, wherein said instrument is a guitar.

11. The instrument of claim 1, wherein said center plate is made from wood.

12. The instrument of claim 1, wherein said center plate is solid and continuous.

13. The instrument of claim 1, wherein said center plate includes at least one through hole.

14. The instrument of claim 1, wherein said center plate includes holes of differing sizes or shapes.

15. The instrument of claim 10, wherein said guitar is an electric guitar and a body receives and carries a bridge and a pick-up and controls.

16. The instrument of claim 15, wherein said front outer shell includes a cavity defining a seat for receiving and holding said pick-up and controls.

17. A method of forming a musical instrument, comprising the steps of:

providing a first mold for forming a front outer shell;

providing a second mold for forming a rear outer shell;

applying a castable material into a cavity associated with each of the mold halves for creating the front and rear shells;

removing the shells from the molds;

positioning a first face of a center plate in abutting contact with an elevated end surface of a perimeter extending side wall of a selected one of the shells;

applying an elevated end surface of a perimeter extending side wall of the other shell in abutting contact against a second opposite face of the center plate; and securing the front outer shell and rear outer shell to the center plate, thereby forming an interior cavity divided by the center plate.

18. The method of claim 17, further comprising the step of communicating a foam material through an aperture in a selected one of the shells for filling at least a portion of the interior cavity.

19. The method of claim 17, further comprising the step of forming an outer flange around the center plate, the flange having opposite facing perimeter channels for seating perimeter extending edges of the formed outer shells in seamless fashion.

20. The method as described in claim 17, further comprising the step of applying a reinforced backing over the castable material in each of said mold halves.

* * * * *